US008801549B2

(12) United States Patent
Leoni

(10) Patent No.: US 8,801,549 B2
(45) Date of Patent: Aug. 12, 2014

(54) FOLDING SPORTS GOAL FOR SOCCER AND THE LIKE

(75) Inventor: Emilio Leoni, Brampton (CA)

(73) Assignee: Laurentian Athletics Industries (1970) Ltd, Ontario (CA)

( * ) Notice: Subject to any disclaimer, the term of this patent is extended or adjusted under 35 U.S.C. 154(b) by 311 days.

(21) Appl. No.: 13/296,411

(22) Filed: Nov. 15, 2011

(65) Prior Publication Data

US 2012/0165139 A1 Jun. 28, 2012

Related U.S. Application Data

(60) Provisional application No. 61/427,380, filed on Dec. 27, 2010.

(51) Int. Cl.
*A63B 63/00* (2006.01)

(52) U.S. Cl.
CPC ..... *A63B 63/00* (2013.01)
USPC ..... 473/478

(58) Field of Classification Search
CPC ..... A63B 63/00
USPC ..... 473/478, 446; 273/400; 403/7; 408/108
See application file for complete search history.

(56) References Cited

U.S. PATENT DOCUMENTS

| | | | | |
|---|---|---|---|---|
| 2,535,450 | A * | 12/1950 | O'Malley | 269/43 |
| 5,186,469 | A * | 2/1993 | Terris | 473/478 |
| 5,273,292 | A * | 12/1993 | Pardi et al. | 273/400 |
| 5,476,266 | A * | 12/1995 | Caruso | 473/478 |
| 5,496,040 | A | 3/1996 | Amburgey et al. | |
| 5,902,195 | A | 5/1999 | Pavonetti | |
| 6,000,944 | A * | 12/1999 | Schiefer | 434/251 |
| 6,402,643 | B1 | 6/2002 | Gill | |
| 6,652,395 | B2 | 11/2003 | Goldwitz | |
| 6,808,463 | B1 | 10/2004 | Stockwell, III | |
| 6,991,567 | B2 | 1/2006 | Wong et al. | |
| 7,074,141 | B2 | 7/2006 | Bryant, Jr. et al. | |
| 7,300,059 | B2 | 11/2007 | Caruso | |
| 7,371,195 | B2 | 5/2008 | Stevens | |
| 2004/0116215 | A1 | 6/2004 | Fobean et al. | |
| 2005/0054464 | A1 | 3/2005 | Bryant, Jr. et al. | |
| 2005/0189719 | A1 | 9/2005 | Goldwitz | |
| 2006/0082067 | A1 | 4/2006 | Wong et al. | |
| 2006/0264274 | A1 | 11/2006 | Bryant, Jr. et al. | |
| 2008/0093804 | A1 | 4/2008 | Caruso | |
| 2012/0165139 | A1 * | 6/2012 | Leoni | 473/478 |

OTHER PUBLICATIONS

Webpage download, freekick, 2010, web.archive.org/web/20100726040537/http://www.firstteaminc.com/products.php?category=Residential+Soccer+Goals, 3 pages.*

(Continued)

*Primary Examiner* — Gene Kim
*Assistant Examiner* — M Chambers
(74) *Attorney, Agent, or Firm* — Price Heneveld LLP

(57) ABSTRACT

A folding sports goal includes a U-shaped front frame which defines the goal opening, a U-shaped base frame with legs pivotally connected with the uprights in the front frame, and a pair of C-shaped side frames with opposite ends pivotally connected with the uprights of the front frame. The erected goal is shifted to a folded storage position by pivoting the side frames inwardly against the front frame, and then folding the base frame upwardly against the side frames and engaging locks which positively retain the goal in a folded storage position.

20 Claims, 4 Drawing Sheets

(56) References Cited

OTHER PUBLICATIONS

Webpage download, colliersports, 2013, www.colliersports.co.uk/product/59/freestanding-aluminium/folding-freestanding, 1 page.*

Webpage download, jaypro, 2003, www.jaypro.com/Documents/ISG-2010.PDF, 7 pages.*

* cited by examiner

FOLDING SPORTS GOAL FOR SOCCER AND THE LIKE

CLAIM OF PRIORITY

Applicant hereby claims the priority benefits under the provisions of 35 U.S.C. §119, basing said claim of priority on U.S. Provisional Patent Application Ser. No. 61/427,380 filed Dec. 27, 2010.

BACKGROUND OF THE INVENTION

The present invention relates to sporting goals, and in particular to a folding goal and associated frame for soccer and the like.

Goals for soccer and other similar sports are generally well known in the art, and typically include a rigid frame about which a flexible net or other similar material is attached to contain an associated ball or other sports projectile.

It is important that such goals have a very rugged construction, which is capable of withstanding substantial abuse from both the weather and zealous game participants. Because such goals have a relatively large and bulky profile when in the fully erected use position, it is desirable that the same are capable of being disassembled and/or collapsed into a smaller profile from storage and/or transport. Sports goals that are designed to be disassembled are susceptible to having the various parts lost or misplaced, and typically cannot be reconfigured without substantial time and energy. Also, many such collapsible sports goal constructions are not as durable or rugged as rigid goals. Hence, a folding goal for soccer and the like which overcomes these disadvantages would clearly be advantageous.

SUMMARY OF THE INVENTION

One aspect of the present invention is a sports goal for soccer and the like having a folding frame with a rigid front frame having an inverted, generally U-shaped front elevational configuration defined by two generally parallel and laterally spaced apart uprights, which are oriented generally vertically in an unfolded use position and have upper and lower portions and an upper cross leg rigidly attached to and interconnecting the upper portions of the uprights, which extends generally horizontally in the unfolded use position to define a goal opening between the uprights and the cross leg. The folding frame also includes a rigid base frame having a generally U-shaped plan configuration, oriented generally horizontally in the unfolded use position and defined by two generally parallel side legs which are spaced laterally apart an amount commensurate with the uprights of the front frame, have forward and rearward portions, and a rear cross leg fixedly attached to and interconnecting the rearward portions of the side legs of the base frame. The forward portions of the side legs of the base frame are pivotally connected with the lower portions of the uprights of the front frame to permit the base frame to be pivoted along a generally vertical plane between the use position in which the base frame is oriented generally horizontally and perpendicular with the front frame, and a folded storage position in which the base frame is oriented generally vertically and parallel with the front frame. The folding frame also includes a pair of rigid side frames, each having a generally C-shaped side elevational configuration with an upper free end thereof, pivotally connected with the upper portion of a associated one of the uprights on the front frame, a lower free end pivotally connected with the lower portion of an associated one of the uprights in the front frame, and an angled medial portion which extends downwardly and rearwardly from the upper free end at a predetermined angle to a rear foot portion thereof, which is located adjacent to and is abuttingly supported on the rearward portion of an associated one of the side legs of the base frame in the unfolded use position and then forwardly in a generally horizontal direction above the associated side leg of the base frame to the lower free end. The side frames are pivoted on the front frame along a generally horizontal plane between the unfolded use position in which the side frames are oriented generally perpendicular with the front frame, and the folded storage position in which the side frames are oriented generally parallel with the front frame. A pair of first lock mechanisms are disposed on the rearward portions of the side legs of the frame. A pair of second lock mechanisms are disposed on the rearward foot portions of the side frames, and lockingly mate with the first lock mechanisms on the base frame in the unfolded use position to securely yet detachably interconnect the same and thereby retain the front frame, the base frame and the side frame in the unfolded use position. A pair of third lock mechanisms are disposed on the uprights in the front frame, and lockingly mate with the first lock mechanisms on the base frame to securely, yet detachably interconnect the same and thereby retain the front frame, the base frame and the side frames in the folded storage position, whereby the sports goal is shifted from the unfolded use position to the folded storage position by sequentially unlocking the first and second lock mechanisms, pivoting the side frames fully inwardly, pivoting the base frame fully upwardly to capture the side frames between the front frame and the base frame, and locking the first and third locking mechanisms.

Yet another aspect of the invention is a folding goal for soccer and other similar sports which has a very rugged and durable construction, and can be quickly and easily shifted between an unfolded position and a folded storage position without disconnecting the various frame members.

Yet another aspect of the present invention is a folding goal for soccer and the like and having a compact storage profile to minimize the required storage space.

Yet another aspect of the present invention is a folding goal for soccer and the like having an uncomplicated design to reduce manufacturing costs, which can be assembled without tools by even unskilled personnel.

Yet another aspect of the present invention is a folding goal for soccer and the like that is efficient in use, economical to manufacture and capable of a long, operating life and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

For purposes of description herein, the terms "upper", "lower", "right", "left", "rear", "front", "vertical", "horizontal" and derivatives thereof shall relate to the invention as oriented in FIGS. 1-4. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
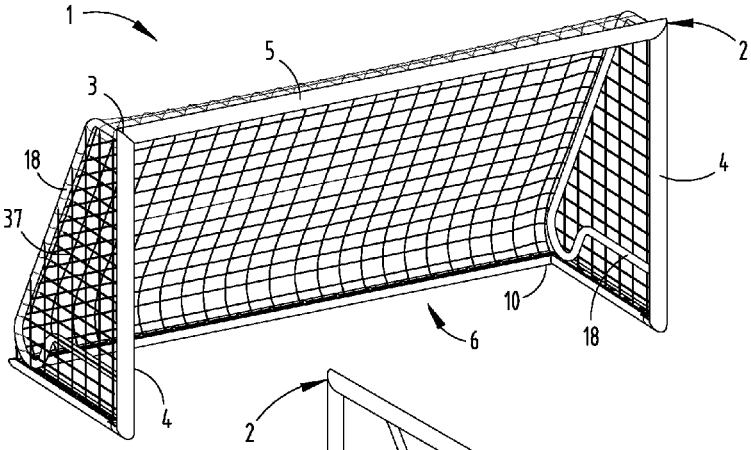
FIG. 1 is a perspective view of a folding sports goal for soccer and the like embodying the present invention, shown in an unfolded use position.
Figure 2:
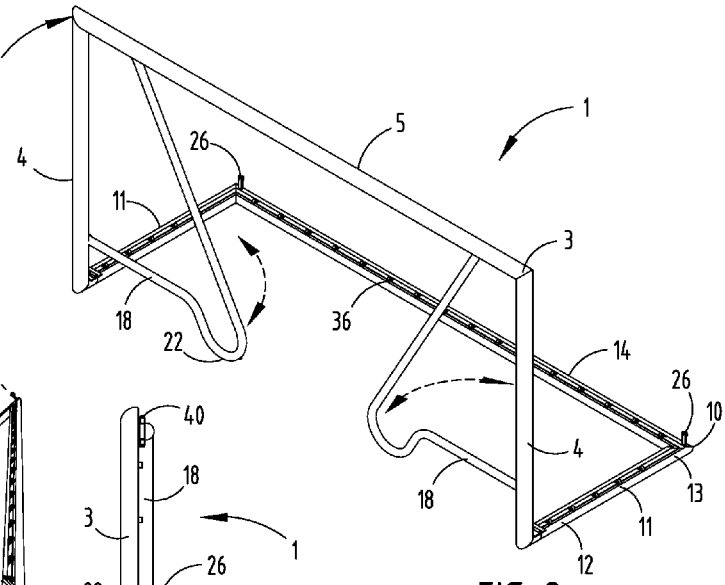
FIG. 2 is a perspective view of the sports goal, wherein side frames have been pivoted to a folded position.
Figure 3:
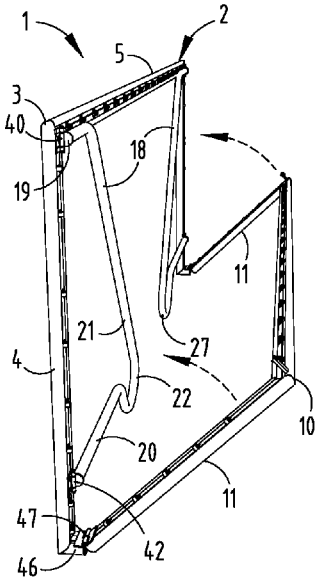
FIG. 3 is a perspective view of the sports goal, wherein a base frame has been pivoted to a partially folded position.
Figure 4:
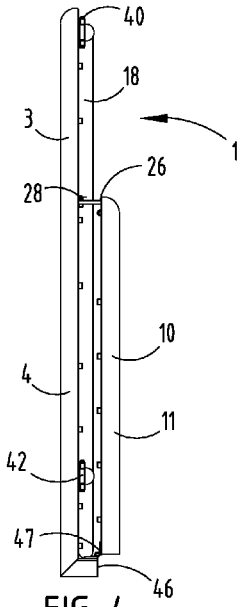
FIG. 4 is a side elevational view of the sports goal, shown in a folded storage position.
Figure 5:
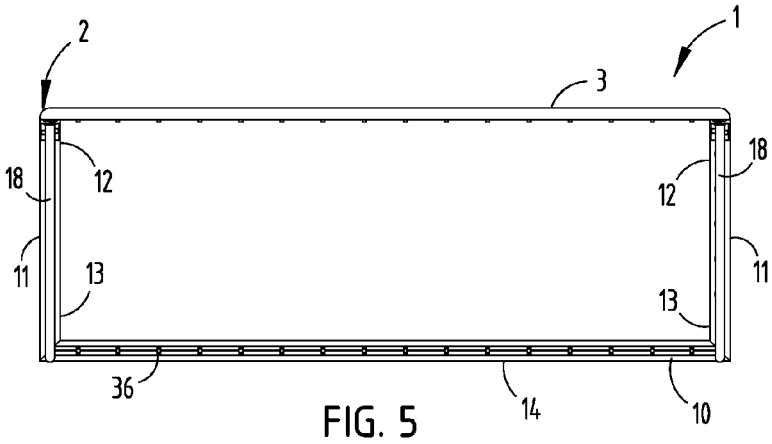
FIG. 5 is a top plan view of the sports goal, shown in the unfolded use position.
Figure 9:
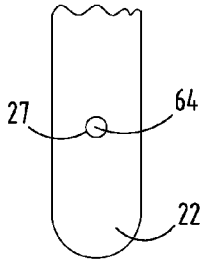
FIG. 9 is a rear elevational view of a lock position at a lower portion of the side frame.
Figure 6:
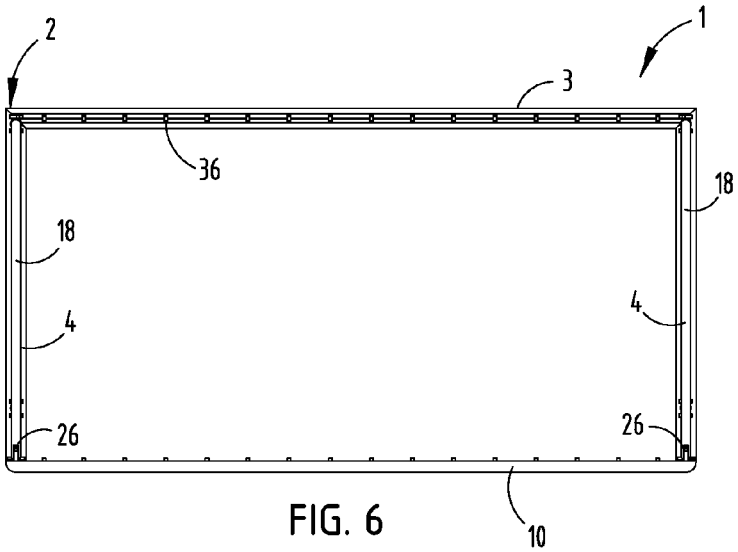
FIG. 6 is a rear elevational view of the sports goal, shown in the unfolded use position.

With reference to FIGS. 1-4, the reference numeral 1 generally designates a sports goal embodying the present invention. The sports goal 1 includes a folding frame 2, comprising a rigid front frame 3 having an inverted, generally U-shaped front elevational configuration defined by two, generally parallel and laterally spaced apart uprights 4 which are oriented generally vertically in an unfolded use position as shown in FIG. 1. Uprights 4 have upper and lower portions, and an upper cross leg 5 is rigidly attached to and interconnects the upper portions of the uprights 4, and extends generally horizontally in the unfolded use position shown in FIG. 1 to define a goal opening 6 between uprights 4 and cross leg 5. Folding frame 3 also includes a rigid base frame 10 having a generally U-shaped plan configuration, oriented generally horizontally in the unfolded use position, and defined by two generally parallel side legs 11, which are spaced apart an amount commensurate with the uprights 4 of front frame 3, and have forward and rearward portion 12 and 13, respectively. A rear cross leg 14 is fixedly attached to and interconnects the rearward portions 13 of the side legs 11 of base frame 10. The forward portions 12 of side legs 11 of base frame 10 are pivotally connected with the lower portions of the uprights 4 of front frame 3 to permit base frame 10 to be pivoted along a generally vertical plane between the unfolded use position (FIG. 1) in which base frame 10 is oriented generally horizontally and perpendicularly with front frame 3, and a folded storage position (FIG. 4) in which base frame 10 is oriented generally vertically and parallel with front frame 3. Folding frame 2 also includes a pair of rigid side frames 18, each having a generally C-shaped side elevational configuration with an upper free end 19 connected with the upper portion of an associated one of the uprights 4 on front frame 3, a lower free end 20 pivotally connected with a lower portion of an associated one of the uprights 4 of front frame 3, and an angled medial portion 21, which extends downwardly and rearwardly from the upper free end 18 at a predetermined angle to a rear foot portion 22 which is located adjacent to and is abuttingly supported on the rearward portion 13 of an associated one of the side legs 11 of face frame 10 in the unfolded use position, and then forwardly in a generally horizontal direction above the associated side leg 11 of base frame 10 to the lower free end 20. The side frames 18 are pivoted on front frame 3 along a generally horizontal plane between the unfolded use position (FIG. 1) in which the side frames 18 are oriented generally perpendicular with the front frame 4, and the folded storage position (FIG. 4) in which the side frames 18 are oriented generally parallel with front frame 3. A pair of first lock mechanisms 26 (FIGS. 1 and 15-17) are disposed on the rearward portion 13 of the side legs 11 of base frame 10. A pair of second lock mechanisms 27 (FIGS. 9 and 15-17) are disposed on the rearward foot portions 22 of the side frames 18, and lockingly mate with the first lock mechanisms 26 on the base frame 10 in the unfolded use position (FIG. 1) to securely, yet detachably, interconnect the same, and thereby retain the front frame 3, the base frame 10, the side frames 18 in the unfolded use position. A pair of third lock mechanisms 28 (FIGS. 4 and 19-22) are disposed on the uprights 3 of front frame 2, and lockingly mate with the first lock mechanisms 26 on the base frame 10 to securely, yet detachably, interconnect the same and thereby retain the front frame 3, the base frame 10 and the side frame 18 in the folded storage position (FIG. 4). The sports goal 1 is shifted from the unfolded use position shown in FIG. 1, to the folded storage position shown in FIG. 4, by sequentially unlocking the first and second lock mechanisms 26, 27, pivoting the side frames 11 fully inwardly, pivoting the base frame 10 fully upwardly to capture the side frames 18 between the front frame 3 and the base frame 10, and then locking the first and third locking mechanisms 26, 28.

The front frame 3 of the illustrated folding frame 2 is constructed from three segments of rigid extrusions that are made from aluminum, steel or the like, as best shown in FIGS.

Figure 10:
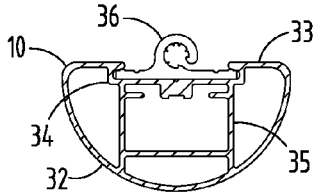
FIG. 10 is a lateral cross-sectional view of a side leg portion of the base frame, shown with a clip mounted in place.
Figure 11:
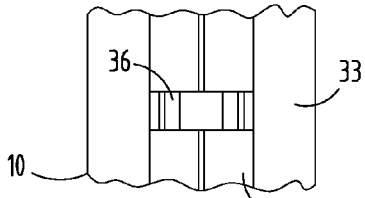
FIG. 11 is a top plan view of the frame and clip shown in FIG. 10.
Figure 25:
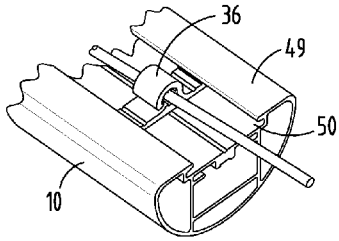
FIG. 25 is a fragmentary perspective view of the base frame upright shown with a clip mounted therein.

10, 11, 13, 14 and 20, and are rigidly connected along biased joints by means such as welding, or the like to define uprights 4 and cross leg 5. Both of the illustrated uprights 4 and the cross leg 5 has a generally arc-shaped front face 32 (FIGS. 10 and 11) and a generally flat rear face 33 with a T-slot 34 extending the length thereof. Internal webbing 35 is provided to add rigidity to the section. T-slot 34 is adapted to selectively receive and retain therein clips 36 in which marginal portions of a net 37 are retained to securely, yet detachably mount net 37 on folding frame 2, as best shown in FIGS. 1 and 25.

Figure 12:
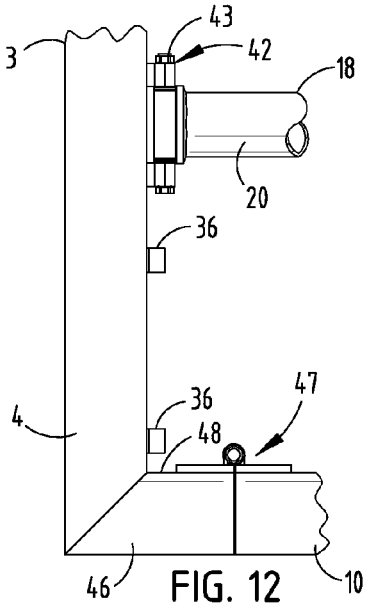
FIG. 12 is a fragmentary side elevational view of the pivotal connection between the base frame and the front frame.
Figure 13:
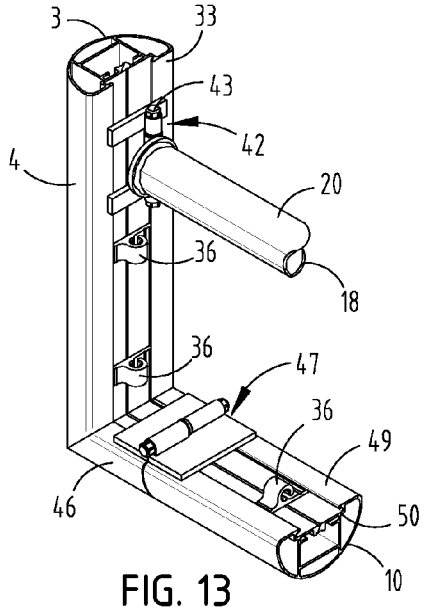
FIG. 13 is a fragmentary perspective view of the pivotal connection between the base frame and the front frame.
Figure 14:
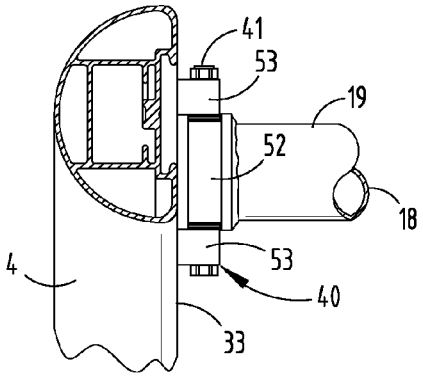
FIG. 14 is a fragmentary cross-sectional view of the pivotal connection between the upper ends of the side frames with the front frame.
Figure 20:
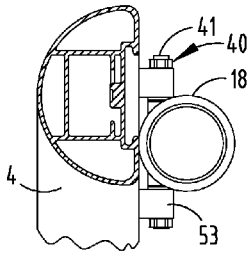
FIG. 20 is a fragmentary cross-sectional view of the connection between the upper portions of the side frames and the front frame shown in the folded storage position.
Figure 21:
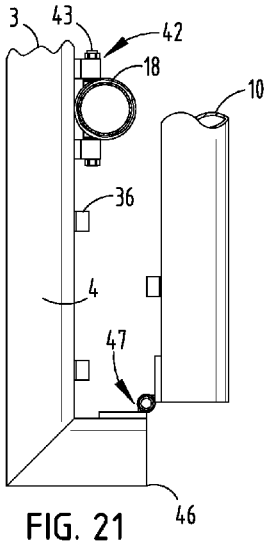
FIG. 21 is a fragmentary side elevational view of the front frame, base frame and side frame shown in the folded storage position.
Figure 23:
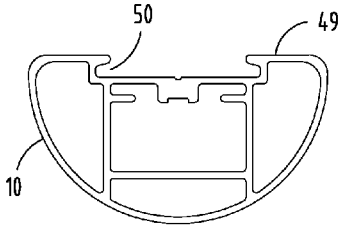
FIG. 23 is a lateral cross-sectional view of the base frame.
Figure 24:
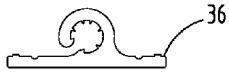
FIG. 24 is a side elevational view of a clip for attaching a net to the frame.

With reference to FIGS. 14 and 20, the upper ends 19 of side frames 18 are pivotally attached to the rear side 33 of upper portions of uprights 4 by a hinge assembly 40 having a vertically disposed hinge pin 41 that permits side frame 18 to rotate in a generally horizontal plane between the unfolded use position and the folded storage position. As best shown in FIGS. 13 and 21, the lower ends 20 of side frames 18 are pivotally attached to the rear faces 33 of the lower portions of uprights 4 by hinge assemblies 42 that include hinge pins 43 that are vertically aligned with the hinge pins 41 of hinge assemblies 40. As best illustrated in FIGS. 12 and 13, the lower ends of uprights 4 include rearwardly extending foot portions 46 which have a sectional shape substantially identical to that of uprights 4, and are abuttingly supported on the playing surface. Hinge assemblies 47 are mounted on the upper faces 48 of feet 46 and serve to pivotally mount base frame 10 thereon in the manner described herein below.

The illustrated base frame 10 is constructed from three segments of extruded rigid material having a cross-sectional shape substantially identical to that of the front frame 3, as best illustrated in FIGS. 13, 15, 16 and 22-25, so as to define side legs 11 and cross leg 14. Side legs 11 and cross leg 14 are rigidly interconnected along biased joints by means such as welding or the like. The upper surfaces 49 of base frame 10 also include T-slots 50 extending the length thereof in which net clips 36 are removably mounted. The forward ends 12 of side legs 11 of base frame 10 are attached to hinge assemblies 47, so as to permit base frame 10 to be rotated along a generally vertical plane between the unfolded use position, and the folded storage position.

The illustrated side frames 18 have a generally tubular construction with a center hinge barrel 52 rigidly fixed to the upper and lower ends thereof 19, 20, which are received in mating end barrels 53 of hinges 40 and 42 to pivotally support both side frames 18 from the rear surfaces of uprights 4.

Figure 7:
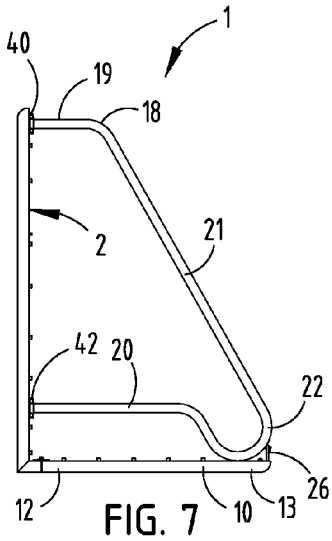
FIG. 7 is a side elevational view of the sports goal, shown in the unfolded use position.
Figure 8:
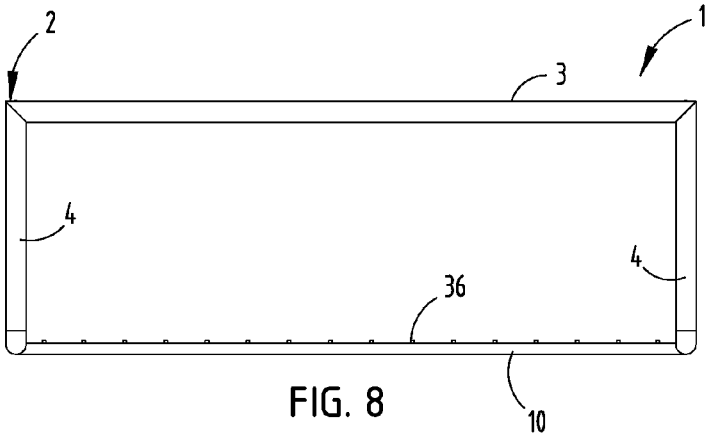
FIG. 8 is a bottom plan view of the sports goal, shown in the unfolded use position.
Figure 16:
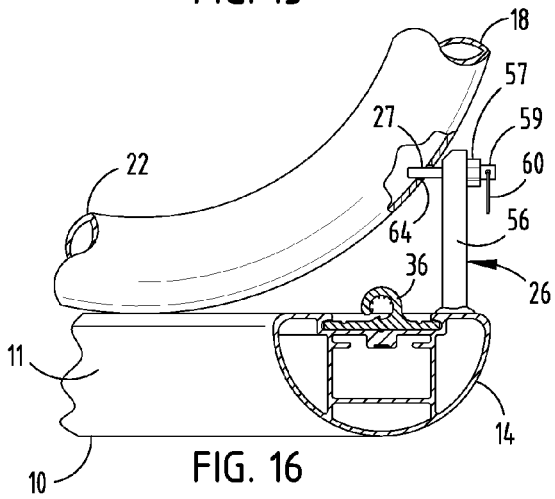
FIG. 16 is a fragmentary cross-sectional view of the lock mechanism shown in FIG. 15.
Figure 15:
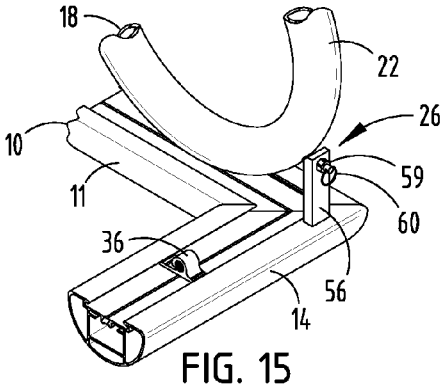
FIG. 15 is a fragmentary perspective view of a lock mechanism which retains the base frame, side frames and front frame in the unfolded use position.
Figure 17:
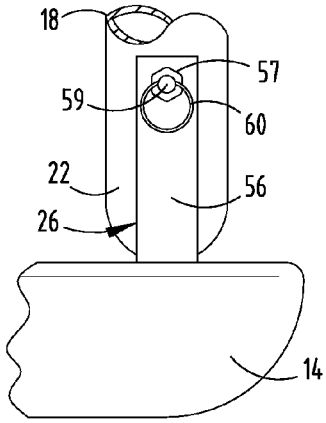
FIG. 17 is a rear elevational view of the lock mechanism shown in FIGS. 15 and 16.

In the illustrated example, the first lock mechanism 26 comprises two lock members that are positioned on the base frame 10 at a location adjacent to the intersection of side legs 11 and cross leg 14, as best illustrated in FIGS. 4 and 7. With reference to FIGS. 15-17, each of the illustrated first lock members 26 includes a rigid strap or plate 56 having its lower end fixedly attached to base frame 10, and extending perpendicularly in a generally upward direction when sports goal 1 is in the unfolded use position shown in FIGS. 15-17. A lock boss 57 is fixedly mounted on an upper portion of plate 56, and includes a through aperture that extends in a direction generally parallel with the longitudinal axis of the side legs 11 of base frame 10, and a lock pin 59 slidingly received in the through aperture for reciprocation between an extended locked position and a retracted unlocked position. In the illustrated example, lock pin 59 includes a ring 60 at the exterior end thereof, which is adapted to facilitate manually shifting lock pin 59 between the locked and unlocked positions, as discussed in greater detail below.

The illustrated second lock mechanism 27 on side frames 18 comprises two apertures 64 located in the rear foot portions 22 of side frames 18, which are aligned axially with the through apertures in the adjacent ones of the first lock mechanisms 26, and are shaped to slidingly receive therein the outer ends of lock pins 59 in the unfolded use position to positively, yet detachably, lock the first lock mechanisms 26 and the second lock mechanisms 27 together. In one example of the present invention, lock apertures 64 may be fanned in lock bosses which are in turn fixedly mounted in rear foot portions 22 of side frames 18. In the unfolded use position, as best illustrated in FIGS. 15-17, the exterior ends of lock pins 59 are retained in the apertures 58 at lock bosses 57, and the interior ends of lock pins 29 are received in the lock apertures 64 in side frames 18 so as to securely, yet detachably retain front frame 3, base frame 10 and both side frames 18 in the unfolded use position. In order to shift folding frame 2 to the folded storage position, lock pins 59 are manually shifted outwardly, so as to disengage the outer ends of lock pins 59 from the lock apertures 54 in side frames 18, and thereby permit side frames 18 to be pivoted inwardly against the inside face of front frame 3 in the manner illustrated in FIG. 2.

Figure 19:
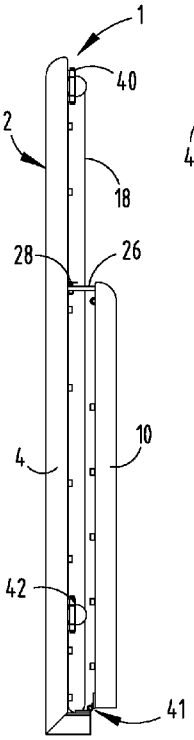
FIG. 19 is a side elevational view of the sports goal shown in the folded storage position.
Figure 18:
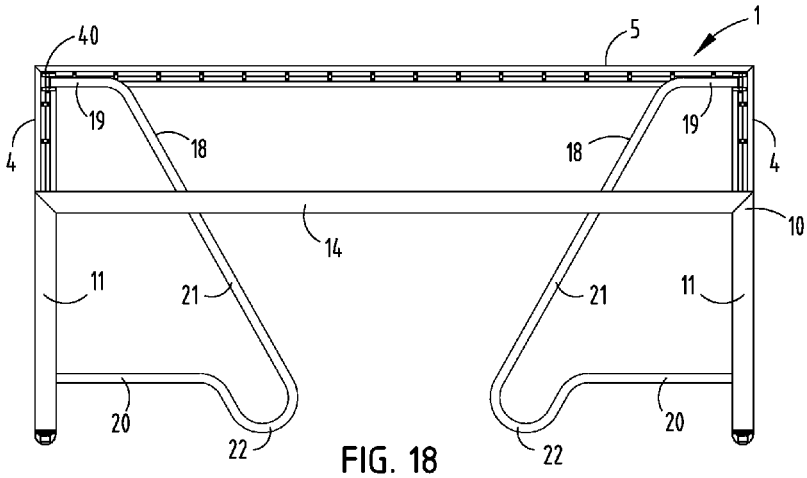
FIG. 18 is a rear elevational view of the sports goal shown in the folded storage position.
Figure 22:
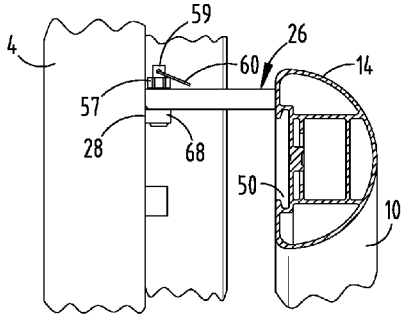
FIG. 22 is a fragmentary cross-sectional view of the front frame, side frames and base frames shown in the folded storage position.

The illustrated third lock mechanisms 28 comprise two lock members that are disposed on the interior faces of uprights 4, as shown in FIG. 22, and include lock bosses 68 with apertures that are aligned axially with the through apertures 58 in the adjacent first locking mechanisms 26, so as to slidingly receive therein the outer ends of the lock pins 59 in the folded storage position to securely, yet detachably lock the first and third lock mechanisms 26, 28, as best shown in FIGS. 19 and 22.

In use, sports goal 1 is shifted from the unfolded use position shown in FIG. 1 to the folded storage position as shown in FIG. 4, by sequentially unlocking the first and second lock mechanisms 26, 27, retracting lock pins 59, pivoting side frames 18 fully inwardly against the interior faces of uprights 4, pivoting base frame 10 fully upwardly to capture side frames 18 between front frame 3 and base frame 10, and then locking the first and third locking mechanisms 26, 28 by extending lock pins 59 into the apertures in lock bosses 68 disposed on the rear faces of uprights 4. To deploy sports goal 1 from the folded storage position to the unfolded use position, the sequence of steps outlined above is simply reversed.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a sports goal for soccer and the like, a folding frame comprising:

a rigid front frame having an inverted, generally U-shaped front elevational configuration defined by two generally parallel and laterally spaced apart uprights which are oriented generally vertically in an unfolded use position and have upper and lower portions, and an upper cross leg rigidly attached to and interconnecting said upper portions of said uprights, which extends generally horizontally in said unfolded use position to define a goal opening between said uprights and said cross leg;

a rigid base frame having a generally U-shaped plan configuration, oriented generally horizontally in said unfolded use position, and defined by two generally parallel side legs which are spaced laterally apart an amount commensurate with said uprights of said front frame and have forward and rearward portions, and a rear cross leg fixedly attached to and interconnecting said rearward portions of said side legs of said base frame; said forward portions of said side legs of said base frame being pivotally connected with said lower portions of said uprights of said front frame to permit said base frame to be pivoted along a generally vertical plane between said unfolded use position in which said base frame is oriented generally horizontally and perpendicular with said front frame, and a folded storage position in which said base frame is oriented generally vertically and parallel with said front frame;

a pair of rigid side frames, each having a generally C-shaped side elevation configuration with an upper free end thereof pivotally connected with said upper portion of an associated one of said uprights on said front frame, a lower free end thereof pivotally connected with said lower portion of an associated one of said uprights of said front frame, and an angled medial portion which extends downwardly and rearwardly from said upper free end at a predetermined angle to a rear foot portion thereof which is located adjacent to and is abuttingly supported on said rearward portion of an associated one of said side legs of said base frame in said unfolded use position, and then forwardly in a generally horizontal direction above said associated side leg of said base frame to said lower free end; said side frames being pivoted on said front frame along a generally horizontal plane between said unfolded use position in which said side frames are oriented generally perpendicular with said front frame, and said folded storage position in which said side frames are oriented generally parallel with said front frame;

a pair of first lock mechanisms disposed on said rearward portions of said side legs of said base frame;

a pair of second lock mechanisms disposed on said rearward foot portions of said side frames, and lockingly mate with said first lock mechanisms on said base frame in said unfolded use position to securely yet detachably interconnect the same and thereby retain said front frame, said base frame and said side frames in said unfolded use position; and a pair of third lock mechanisms disposed on said uprights of said front frame, and lockingly mating with said first lock mechanisms on said base frame to securely yet detachably interconnect the same and thereby retain said front frame, said base frame and said side frames in said folded storage position, whereby said sports goal is shifted from said unfolded storage position to said folded use position by sequentially unlocking said first and second lock mechanism, pivoting said side frames fully inwardly, pivoting said base frame fully upwardly to capture said side frames between said front frame and said base frame, and locking said first and third locking mechanisms.

2. A sports goal as set forth in claim 1, wherein:

each of said pair of first lock mechanisms includes a lock boss fixedly connected with said base frame and having a through aperture therein which extends in a direction generally parallel with the longitudinal axis of said side members of said base frame, and a lock pin slidingly received in said through aperture for reciprocation between an extended locked position and a retracted unlocked position.

3. A sports goal as set forth in claim 2, wherein:

each of said pair of second lock mechanisms includes an aperture in an associated one of said side frames which is aligned axially with said through aperture in said adjacent one of said first lock mechanisms and slidingly receives an outer end of said lock pin therein in said unfolded use position to securely yet detachably lock said first and second lock mechanisms together.

4. A sports goal as set forth in claim 3, wherein:

each of said pair of second lock mechanisms includes a lock boss fixedly connected with said rear foot portion of an associated one of said side frames and has said aperture therein.

5. A sports goal as set forth in claim 4, wherein:

each of said pair of third lock mechanisms includes a lock boss fixedly connected with an associated one of the uprights of said front frame and having an aperture therein which is aligned axially with said through aperture in said adjacent one of said first locking mechanisms and slidingly receives said outer end of said lock pin therein in said folded storage position to securely yet detachably lock said first and third lock mechanisms together.

6. A sports goal as set forth in claim 5, wherein:

said pair of first lock mechanisms is configured such that each said lock pin is carried with and retained in said through aperture of the associated one of said lock bosses of said first lock mechanisms when said lock pin is shifted to said retracted unlocked position to facilitate direct insertion into said through apertures of said second and third lock mechanisms.

7. A sports goal as set forth in claim 6, wherein:

each of said pair of side frames has a one-piece tubular construction with a formed U-shaped area which defines said rear foot portion.

8. A sports goal as set forth in claim 7, wherein:

said uprights and said top cross leg of said front frame have a substantially similar lateral cross-sectional shape which includes a T-shaped channel extending along a rearward surface thereof; and including a plurality of clips detachably retained in said T-shaped channel of said front frame for mounting a net on said front frame.

9. A sports goal as set forth in claim 8, wherein:

said side legs and said rear cross leg of said base frame have a lateral cross-sectional shape that is substantially similar with the lateral cross-sectional shape of said front frame, and includes a similarly configured T-shaped channel extending along an upper surface thereof; and including a plurality of said clips detachably retained in said T-shaped channel of said base frame for mounting a net on said base frame.

10. A sports goal as set forth in claim 9, including:

a net retained in said clips detachably supported in said T-shaped channel in said front frame and said base frame, which is automatically folded between said front frame, said side frames and said base frame when said folding goal is shifted to said folded storage position.

11. A sports goal as set forth in claim 10, wherein:

said upper and lower free ends of said side frames are pivotally attached to said uprights of said front frame at locations disposed interior of said T-shaped channel in said front frame, such that said side frames are positioned interior of said net.

12. A sports goal as set forth in claim 11, wherein:

said uprights on said front frame have lower ends which abuttingly support at least a portion of said folding goal on a surface; and said lower free ends of said side frames are pivotally attached to said uprights of said front frame at locations disposed a spaced apart distance above said lower ends of said uprights to avoid ground engagement during the shifting of said side frames between said unfolded use position and said folded storage position.

13. A sports goal as set forth in claim 2, wherein:

each of said pair of third lock mechanisms includes a lock boss fixedly connected with an associated one of the uprights of said front frame and having a through aperture therein which is aligned axially with said through aperture in said adjacent one of said first locking mechanisms and slidingly receives said outer end of said lock pin therein in said folded storage position to securely yet detachably lock said first and third lock mechanisms together.

14. A sports goal as set forth in claim 2, wherein:

said pair of first lock mechanisms is configured such that each said lock pin is carried with and retained in said through aperture of the associated one of said lock bosses of said first lock mechanisms when said lock pin is shifted to said retracted unlocked position to facilitate direct insertion into said through apertures of said second and third lock mechanisms.

15. A sports goal as set forth in claim 1, wherein:

each of said pair of side frames has a one-piece tubular construction with a formed U-shaped area which defines said rear foot portion.

16. A sports goal as set forth in claim 15, wherein:

said side legs and said rear cross leg of said base frame have a lateral cross-sectional shape that is substantially similar with the lateral cross-sectional shape of said front frame, and includes a similarly configured T-shaped channel extending along an upper surface thereof; and including a plurality of said clips detachably retained in said T-shaped channel of said base frame for mounting a net on said base frame.

17. A sports goal as set forth in claim 1, wherein:

said uprights and said top cross leg of said front frame have a substantially similar lateral cross-sectional shape which includes a T-shaped channel extending along a rearward surface thereof; and including a plurality of clips detachably retained in said T-shaped channel of said front frame for mounting a net on said front frame.

18. A sports goal as set forth in claim 16, wherein:

said upper and lower free ends of said side frames are pivotally attached to said uprights of said front frame at locations disposed interior of said T-shaped channel in said front frame, such that said side frames are positioned interior of said net.

19. A sports goal as set forth in claim 17, including:

a net retained in said clips detachably supported in said T-shaped channel in said front frame and said base frame, which is automatically folded between said front frame, said side frames and said base frame when said folding goal is shifted to said folded storage position.

20. A sports goal as set forth in claim 1, wherein:

said uprights on said front frame have lower ends which abuttingly support at least a portion of said folding goal on a surface; and said lower free ends of said side frames are pivotally attached to said uprights of said front frame at locations disposed a spaced apart distance above said lower ends of said uprights to avoid ground engagement during the shifting of said side frames between said unfolded use position and said folded storage position.

* * * * *